United States Patent [19]

Strahm

[11] Patent Number: 4,969,243

[45] Date of Patent: Nov. 13, 1990

[54] METHOD AND APPARATUS FOR COMPRESSIVE SHRINKAGE OF FABRIC

[75] Inventor: Christian Strahm, Bronschhofen, Switzerland

[73] Assignee: Santex AG, Tobel, Switzerland

[21] Appl. No.: 381,591

[22] Filed: Jul. 18, 1989

[30] Foreign Application Priority Data

Jul. 18, 1988 [CH] Switzerland ..... 02734/88

[51] Int. Cl.[5] ..... D06C 21/00

[52] U.S. Cl. ..... 26/18.6

[58] Field of Search ..... 26/18.6, 18.5, 19

[56] References Cited

U.S. PATENT DOCUMENTS

| | | | |
|---|---|---|---|
| 1,971,211 | 8/1934 | Cluett | 26/18.6 |
| 2,209,205 | 7/1940 | Neville | 26/18.6 X |
| 2,374,482 | 4/1945 | Hadfield et al. | 26/18.6 |
| 2,870,038 | 1/1959 | MacIntyre | 26/18.6 X |
| 3,484,949 | 12/1969 | Aronoff | 34/155 |
| 3,585,696 | 6/1971 | Aronoff | 26/18.5 |
| 3,940,833 | 3/1976 | Troope et al. | 26/18.6 |
| 4,156,955 | 6/1979 | Joy | 26/18.6 |
| 4,247,969 | 2/1981 | Diggle, Jr. et al. | 26/18.6 |
| 4,562,627 | 1/1986 | Milligan | 26/18.5 |
| 4,603,799 | 8/1986 | Schaerer | 226/171 |

FOREIGN PATENT DOCUMENTS

| | | | |
|---|---|---|---|
| 1564431 | 4/1969 | France . | |
| 2242504 | 3/1975 | France . | |
| 2318968 | 2/1977 | France . | |
| 194050 | 5/1967 | U.S.S.R. | 26/81 |
| 542774 | 1/1977 | U.S.S.R. | 26/81 |
| 553316 | 6/1977 | U.S.S.R. | 26/81 |
| 739157 | 5/1980 | U.S.S.R. | 26/81 |
| 1106773 | 3/1968 | United Kingdom | 26/18.6 |

*Primary Examiner*—Werner H. Schroeder
*Assistant Examiner*—Bradley Kurtz DeSandro
*Attorney, Agent, or Firm*—Watts, Hoffmann, Fisher & Heinke Co.

[57] ABSTRACT

A process and apparatus for shrinking and smoothing single layer or tubular textile material where the material is first pre-shrunk by conveyance along a first curved path through a heated curved pull-in gap formed by a guide shoe and a pull-in conveyor roller. The material is then conveyed along a second curved path, curved oppositely to the first curved path, and then to a compaction zone formed by cooperation between a smoothing conveyor and a shrinkage conveyor belt. The size of the pull-in gap and the speed of the pull-in conveyor may be varied in order to achieve a variation in the residual shrinkage of the material.

23 Claims, 2 Drawing Sheets

METHOD AND APPARATUS FOR COMPRESSIVE SHRINKAGE OF FABRIC

CROSS-REFERENCES TO RELATED APPLICATIONS

This application is related to the commonly assigned co-pending application of Strahm et al. Ser. No. 07/207,760 filed June 16, 1988.

BACKGROUND OF THE INVENTION

1. Field of the Invention.

This invention relates to the smoothing and shrinking of fabrics and more particularly to the smoothing and shrinking of textile material, either tubular or open, through the use of moisture and calendaring.

2. Description of the Related Art.

In one known process, a predetermined residual shrinkage value can be obtained by connecting an additional shrinking dryer in the sequence. This involves additional expense and investments. This process also has the disadvantage that with lines of goods consisting of different materials, different shrinkage values are obtained and there is no possibility of getting definite predetermined residual shrinkage with this known treatment.

For many textiles, for example, a residual shrinkage value of about 3% is desired. Such shrunk goods do not shrink much further in a washing machine, and on the other hand, do not stretch much when hung on a clothesline for drying. This means that with a residual shrinkage value of about 3%, an acceptable compromise can be reached for the different washing and drying methods.

The purpose of the present invention, therefore, is to provide a process where, on the one hand, a much stronger shrinkage than heretofore accomplished is achieved, and which, even in material lines differing as to material and processing, makes possible the predetermined production of a definite residual shrinkage value.

SUMMARY OF THE INVENTION

The invention involves a process and apparatus for continuous smoothing and shrinking of single layer or tubular textile material. A pre-shrinking stage is used in order to achieve stronger shrinking. In addition, the pre-shrinking stage gives the ability to predetermine the residual shrinkage value of the material.

Steps of the process are as follows: furnishing textile material from a supply; feeding the textile material along a path to a pre-shrinking stage, the pre-shrinking stage including the steps of: guiding the textile material along a first curved path through a pull-in gap narrowing in the direction of transport, the pull-in gap being formed by the cooperation of a guide shoe and a pull-in conveyor; feeding the textile material into a nip formed by the pull-in conveyor and a shrinkage conveyor belt or belts. Following the pre-shrinking stage, the textile material is passed to the outermost surface of the shrinkage conveyor belt. The textile material is then conveyed along a second curved path which extends along a zone where the outermost surface of the shrinkage conveyor belt is in an expanded condition. The textile material is conveyed along a third curved path, curved oppositely to the second curved path, the third path being formed by a smoothing conveyor lying against the shrinkage conveyor belt or belts. The third curved path is a compaction zone where the textile material is compacted along its surface area.

The apparatus for smoothing and shrinking textile material has the following elements: a pull-in conveyor; a guide shoe cooperating with the pull-in conveyor to form a pull-in gap through which the textile material passes along a first curved path; a shrinkage conveyor belt or belts cooperating with the pull-in conveyor to form a nip, the nip leading to a second curved path curved oppositely to the first curved path; and a smoothing roller cooperating with the shrinkage conveyor belt or belts to form a third curved path curved oppositely to the second curved path.

By varying the size of the pull-in gap and the speed of the pull-in conveyor, a predetermined shrinkage value may be achieved. Furthermore, more than one shrinking and smoothing unit may be arranged in series in order to treat the same side of the material more than once or to give both sides of the material the same treatment.

DESCRIPTION OF THE PREFERRED EMBODIMENT

Figure 1:
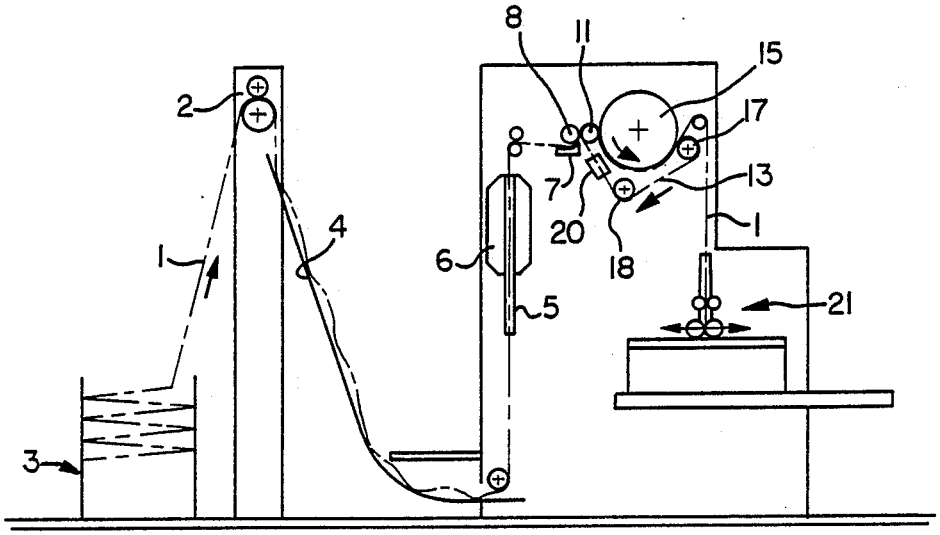
FIG. 1 is a elevational view in schematic form of one embodiment of the smoothing and shrinking apparatus.

As shown in FIG. 1, the textile material 1 to be treated is pulled by means of a supply conveyor 2 from a supply container 3. The textile material 1 is then fed over a slide 4 to a lateral stretching unit 5. The textile material is then conveyed through a dampening unit 6. In the dampening unit 6, the textile material 1 to be treated is uniformly and intensively dampened by steam from both sides until it has absorbed moisture in the range of 5 to 20 percent of its weight, preferably 10 to 15 percent of its weight.

Figure 2:
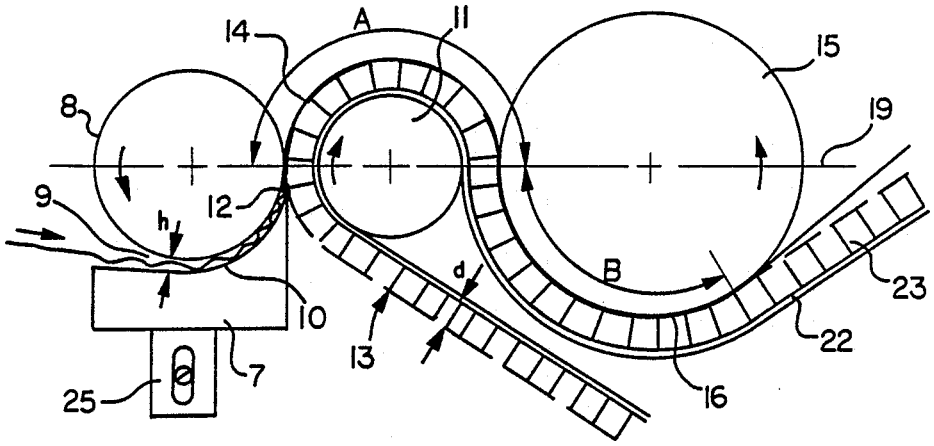
FIG. 2 is a more detailed schematic diagram of the roller and shrinkage conveyor belt arrangement which forms a part of the apparatus of FIG. 1.

Then the textile material 1, as perhaps best seen in FIG. 2, is overfed in a loose condition to a heated shrinking and guide shoe 7. From there the textile material 1 is fed to a pull-in gap 9, which narrows in the direction of transport. The curved path that the textile material follows in this gap is identified as a first curved path. This pull-in gap 9 is formed by a pull-in conveyor 8 and the guide shoe 7. Either or both of the guide shoe 7 and the pull-in conveyor 8 are heated and cooled so the temperature at the pull-in gap 9 can be regulated.

The textile material 1 is pre-shrunk as it passes along the curved surface 10 of the pull-in gap 9. The distance h that guide shoe 7 sits apart from the pull-in conveyor 8 is adjustable. Also, the revolutions per minute that the pull-in conveyor 8 turns is adjustable. By changing these two variables, the shrinkage value is varied. In other words, the choice of a speed for pull-in conveyor 8 and a position for the guide shoe 7 affects the residual shrinkage value.

The guide shoe 7 is adjustable so that the distance from pull-in conveyor 8 and the angle of the guide shoe and the position of the guide shoe along the conveyor path is adjusted according to the material being treated.

That is, the guide shoe 7 is adjustably pivotable about an axis which is parallel to the axis of the pull-in conveyor 8 such that the degree of narrowing of the pull-in gap 9 is adjustable. Thus the degree of narrowing of the pull-in gap 9 may be adapted to the particular requirements. In addition, the entire guide shoe 7, without changing its angle, may be moved closer or further away from the pull-in conveyor 8. Note the schematic depiction of an adjustable mounting bracket 25 in FIG. 2. The step of passing the moistened textile material 1 along the curved surface 10 through the heated pull-in gap 9 pre-shrinks the textile material, and more particularly, does so in a way that may be adjusted such that a desired shrinkage value is achieved.

The textile material, now pre-shrunk to a selected value, is then fed through outlet 12 with overfeed in an oppositely curved direction along a second curved path. This second curved path is seen in FIG. 2 as zone A. The textile material is spread on a surface 14 of a steam permeable, shrinkage conveyor belt 13 in a tension-free state. The shrinkage conveyor belt 13 is set to have a slower peripheral velocity than the pull-in conveyor 8, thus the textile material is overfed from the pull-in conveyor to the shrinkage conveyor belt.

The surface of the shrinkage conveyor belt 13 forms a nip with the pull-in conveyor 8. This nip is adjacent the outlet 12 formed between the pull-in conveyor 8 and the guide shoe 7. As the textile material is passed through the outlet 12, it is given up to the shrinkage conveyor belt 13. The textile material 1 now passes through an expansion zone A as seen in FIG. 2.

Through zone A, the outermost surface of the shrinkage conveyor 13 is in an expanded state. The shrinkage conveyor 13 is supported by roller 11 as well as rollers 17 and 18. The surface speed of the shrinkage conveyor 13 is adjustable and is preferably greater than that of the pull-in conveyor 8.

The textile material is then fed in an oppositely curved path 16 through a compaction zone B seen in FIG. 2. A continuously running smoothing cylinder 15 having a chrome plated surface cooperates with the surface of the shrinkage conveyor belt 13 in the compaction zone B. The circumferential speed of the smoothing cylinder 15 is normally slightly less than the speed of the shrinkage conveyor belt 13 in order to prevent gloss on the surface of the goods and to attain the best possible shrinkage value.

As can be seen from FIGS. 1 and 2, the shrinkage conveyor belt 13, in order to obtain an additional textile material processing effect, consists on its inner side directed against rollers 11, 17, and 18 of a base support material 22. Base support material 22 is steam permeable and armored with reinforcing threads and practically non-stretching in operation. The outside of the shrinkage conveyor belt 13, which faces the textile material being processed, is made up of steam-permeable felt or pile and is extremely elastic.

The axes of rotation of the pull-in roller 8, the turning roller 11 and the smoothing roller 15 all lie in a common plane 19. The smoothing roller 15 is heated on the outside to a temperature in the range of about 80° to 160° C., preferably 110° to 120° C.

In order to use as little fluid and energy as possible in the steaming station 6, it is advantageous, for some textile material 1 to use a shrinkage conveyor belt 13 provided on its support side with a fluid storing textile material. A moistening and/or drying unit 20 may be used to control exactly the automatically regulated degree of moistening of the shrinkage conveyor belt 13.

After final shrinking has taken place, the textile material 1, shrunk to an exact shrinkage value, is delivered with the aid of a precision off-tabling device 21.

With such a design of the shrinkage conveyor belt 13, it is quite clear that the highly elastic material supporting surface in zone A, will be expanded due to the outward curvature. In zone B, the textile material will be compressed due to the inward curvature of the shrinkage conveyor belt 13. The greater the thickness of the highly elastic layer 23 of shrinkage conveyor belt 13, the greater this effect.

Figure 3:
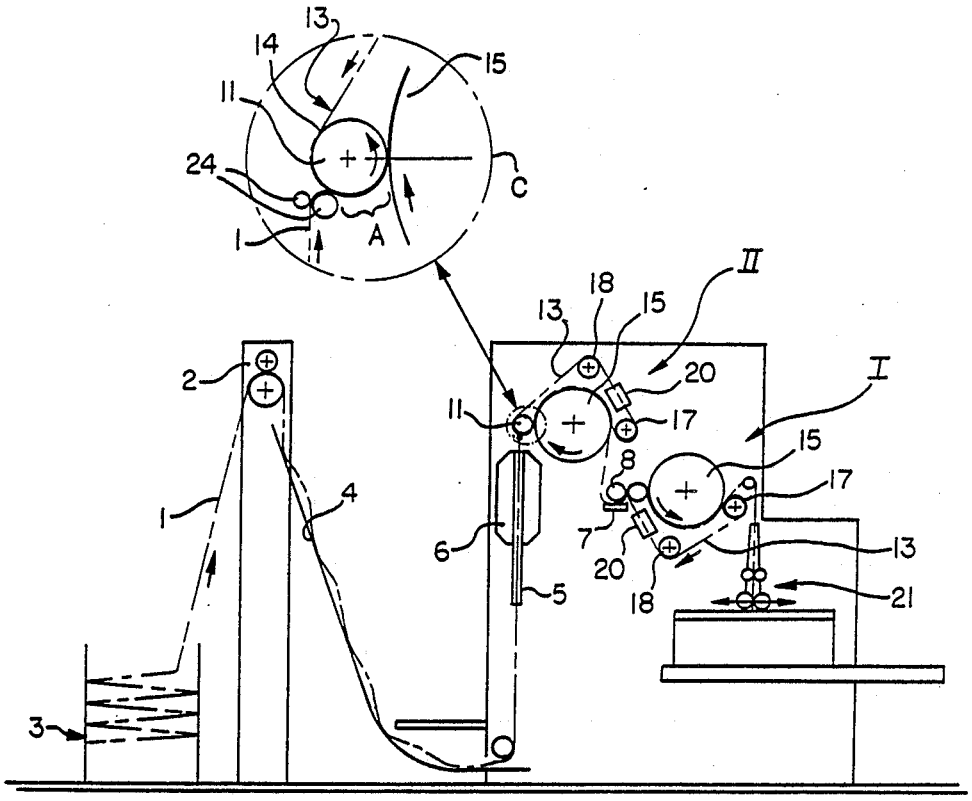
FIG. 3 is a elevational view in schematic form of another embodiment of the smoothing and shrinking apparatus including an inset showing a more detailed view of the roller and shrinkage conveyor belt arrangement.

In the second embodiment of the invention, as seen in FIG. 3, parts similar to those in FIG. 1 have the same reference numbers so that a repeated description of those parts is unnecessary. In the device of FIG. 3, a similar unit II is disclosed in order to obtain greater shrinking. Unlike the unit I, the unit II has no guide shoe. Note the enlarged detail inset of FIG. 3. A simple pair of feed rollers 24 are provided to deliver the textile material 1 to the expanded elastic support surface 14 of shrinkage conveyor belt 13 in zone A. The rest of the parts of the unit II correspond to the similar parts of the previously described unit I shown in FIGS. 1 and 2.

It is also possible, in order to obtain a still stronger shrinking and/or a more uniform treatment of mesh hose material to make the unit II equal to the unit I; that is, instead of employing the pair of feed rolls 24 at the entrance of unit II, a shrinking and guide shoe 7 as well as a pull-in conveyor 8 cooperating with the guide shoe, 7 may be employed. This allows adjustable pre-shrinking of the textile material before it is delivered to the shrinking and smoothing roller 15 of the unit II so that both sides of the textile material are equally treated. In such an apparatus where more than one shrinking and smoothing unit is arranged in series, the smoothing roller 15 of the first unit is heated and the smoothing roller 15 of the last unit may be heated or cooled. Where a plurality of shrinking and smoothing units are used, the invention contemplates at least one of the shrinkage conveyor belts to have associated with it a moistening and drying unit 20.

It is also possible to connect a third unit after unit I corresponding to unit II, or to change the sequence of units I and II. That is, arrange the unit II after the unit I.

The foregoing is considered as illustrative of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention as claimed.

I claim:

1. A process for continuous smoothing and shrinking of textile material which comprises the steps of:

feeding a textile material along a path to a pre-shrinking stage, said pre-shrinking stage comprising the steps of:

guiding said textile material along a first curved path through a gap narrowing in the direction of transport, said gap being formed by the cooperation of a guide means and a pull-in conveyor;

feeding said textile material into a nip formed by said pull-in conveyor and a shrinkage conveyor means;

passing said textile material to said shrinkage conveyor means;

conveying said textile material along a second curved path, curved oppositely to said first curved path and formed by said shrinkage conveyor means; and, conveying said textile material along a third curved path, curved oppositely to said second curved path and formed by a smoothing conveyor lying against said shrinkage conveyor means.

2. A process as claimed in claim 1 including the step of stretching said textile material laterally with respect to the path of travel prior to feeding said textile material to a pre-shrinking stage.

3. A process as claimed in claim 1 where said textile material is overfed as it passes from said pull-in conveyor to said shrinkage conveyor means.

4. A process as claimed in claim 1 where the peripheral velocity of said smoothing conveyor is made equal to or less than that of said shrinkage conveyor means.

5. A process as claimed in claim 1 where, in addition, a second stage of shrinkage and smoothing is provided where all said process steps are repeated with the opposite side of said textile material contacting said shrinkage conveyor means.

6. A process according to claim 1, where said textile material, either before or after carrying out the steps recited in claim 1, is brought into contact with the outer side of another shrinkage conveyor means and conveyed along a first curved path;

fed into engagement with another smoothing cylinder;

guided around part of the circumference of said another smoothing conveyor along a second curved path, curved oppositely to said first curved path.

7. A process according to claim 2 comprising a further step of moistening said textile material to a level of 5 to 20 percent of its weight after said textile material is laterally stretched.

8. A process according to claim 1 where said smoothing conveyor is heated to-a temperature of 80° to 120° C.

9. A process according to claim 1 including the step of regulating the moisture level of said shrinkage conveyor means through the operation of a shrinkage conveyor moistening and drying unit.

10. Apparatus for smoothing and shrinking textile material comprising:

a pull-in conveyor;

a guide shoe cooperating with said pull-in conveyor to form a gap through which said textile material passes along a first curved path;

a shrinkage conveyor means cooperating with said pull-in conveyor means to form a nip, said nip leading to a second curved path curved oppositely to said first curved path; and, a smoothing roller cooperating with said shrinkage conveyor means to form a third curved path curved oppositely to said second curved path.

11. Apparatus according to claim 10 where the peripheral velocity of said shrinkage conveyor means is made less than that of said pull-in conveyor.

12. Apparatus according to claim 10 where a lateral stretching means is provided to stretch said textile material laterally with respect to the path of travel of said textile material prior to said textile material reaching said pull-in conveyor.

13. Apparatus according to claim 10 where the circumferential velocity of said smoothing roller is made to be equal to or less than the circumferential velocity of said shrinkage conveyor means.

14. Apparatus according to claim 10 where said shrinkage conveyor means comprises a base support material which is substantially non-stretchable in operation, on which is arranged an elastic layer which expands and contracts in response to varying path directions.

15. Apparatus according to claim 10 where said shrinkage conveyor means has a steam permeable stretchable base support layer.

16. Apparatus according to claim 14 where said elastic layer consists of felt or pile.

17. Apparatus according to claim 10 where said shrinkage conveyor means is provided with a moistening and drying unit to regulate the level of moisture contained in said shrinkage conveyor means.

18. Apparatus according to claim 10 where said shrinkage conveyor means on its inner side comprises a substantially non-stretchable, steam permeable base support material and on its outer side comprises a steam permeable felt or pile layer.

19. Apparatus according to claim 10 where the circumferential velocity of said pull-in conveyor is adjustable in relation to the circumferential velocity of said shrinkage conveyor means.

20. Apparatus according to claim 10 where the distance between said guide shoe and said pull-in conveyor means is readily adjustable.

21. Apparatus according to claim 10 where the angle of said guide shoe in relation to the path of travel of said textile material and the distance between said guide shoe and said pull-in conveyor means is readily adjustable.

22. Apparatus according to claim 10 where said guide shoe is provided with heating and cooling means so that its temperature is regulated.

23. Apparatus for smoothing and shrinking textile material comprising:

a pull-in conveyor, the circumferential velocity of said pull-in conveyor being adjustable;

a guide means cooperating with said pull-in conveyor to form a gap through which said textile material passes along a first curved path, the distance between said guide means and said pull-in conveyor being adjustable;

heating means provided in one of said guide means and said pull-in conveyor;

a shrinkage conveyor means cooperating with said pull-in conveyor means to form a nip, said nip leading to a second curved path curved oppositely to said first curved path; and, a smoothing conveyor cooperating with said shrinkage conveyor means to form a third curved path curved oppositely to said second curved path.

* * * * *